United States Patent [19]

Miehe et al.

[11] Patent Number: 5,058,937

[45] Date of Patent: Oct. 22, 1991

[54] FLUSH DOOR LATCH ASSEMBLY

[75] Inventors: Donald R. Miehe, Waterloo; Marvin L. Larsen, New Hampton, both of Iowa

[73] Assignee: Tri/Mark Corporation, New Hampton, Iowa

[21] Appl. No.: 655,115

[22] Filed: Feb. 14, 1991

[51] Int. Cl.[5] ..... E05C 9/06

[52] U.S. Cl. ..... 292/34; 292/165; 292/DIG. 31; 292/DIG. 62

[58] Field of Search ..... 292/DIG. 31, DIG. 62, 292/34, 36, 165, 336.3

[56] References Cited

U.S. PATENT DOCUMENTS 2,355,449 8/1944 Lakin ..... 292/165 X
2,735,706 2/1956 Pelcin ..... 292/34
4,510,779 4/1985 Ahad ..... 292/DIG. 31 X
4,989,907 2/1991 Edmonds et al. ..... 292/DIG. 31 X

*Primary Examiner*—Richard E. Moore
*Attorney, Agent, or Firm*—Wood, Phillips, Mason, Recktenwald & Van Santen

[57] ABSTRACT

A flush door latch assembly having a housing with a recess defined therein and a paddle within the recess. Pulling on the paddle causes a cam having a helical cam face to cooperate with a cam follower to cause rotation of a pivot plate that retracts the plunger bolt and permits a door, hatch or the like having the present door latch assembly to be opened. The plunger bolt travels towards the same side of the latch assembly that the paddle travels towards when the plunger bolt is being retracted.

16 Claims, 3 Drawing Sheets

FLUSH DOOR LATCH ASSEMBLY

TECHNICAL FIELD

The present invention relates to flush door latch assemblies and, in particular, to a flush door latch assembly wherein the paddle and plunger bolt both move in the same direction when retracting the plunger bolt.

BACKGROUND OF THE INVENTION

Latch assemblies have many uses in keeping doors, hatches, lids, and the like in a closed position. Some styles of latch assemblies are known as flush latch assemblies because the handle is in a recess in a face of a housing and is flush with the face. Flush assemblies are utilized in mobile homes, recreational vehicles, overhead passenger carry-on baggage compartments, and the like.

Conventionally, the flush latch assemblies have the housing with the recess and a back wall that defines the depth of the recess. The back wall defines an opening therethrough. An elongated bolt is associated with the housing on a side of the back wall opposed to the side that defines the recess. A mechanical link, such as a leg, is affixed to the handle, extends through the opening in the back wall and operates on the bolt to retract the same. Unfortunately, the mechanical link often requires that the opening be larger than the mechanical link. Thus, moisture can go through the opening and affect the internal parts of the latch assembly causing damage to the parts or otherwise hindering the operation of the latch assembly.

Pulling the handle results in the substantially rotational motion of the handle being transferred to the mechanical link which transforms the rotational motion to a linear motion to retract the bolt. Typically, when the flush assembly is inserted in a door with the bolt pointing down, the handle is pulled down, and the mechanical link causes the bolt to move up and be retracted. The handle can have a tendency to fall away from the door which is undesirable because if something accidentally hooks on the handle and pulls it down, the door can accidentally be opened.

If it is desired to have more than one bolt or a bolt and a rod, additional mechanical links usually have to be provided therebetween. This complicates the latch assembly, increases the cost of manufacture, and increases the possibility of moisture penetration.

There is a need for a flush door latch assembly wherein when the bolt is pointing down, the handle is lifted up to retract the bolt. Also, there is a need for a flush door latch assembly that minimizes or eliminates moisture passing through the opening in the back wall thereof. Additionally, a flush door latch assembly that operates smoothly and that is easy to assemble and capable of operating more than one bolt without requiring additional linkage through the opening in the back wall would be desirable.

SUMMARY OF THE INVENTION

The present invention is directed to a flush door latch assembly that has a latch housing having a front panel and an edge that forms a perimeter of a centrally located opening in the front panel. A connected top wall, bottom wall, first side wall and second side wall of the latch housing extend inward from the edge and terminate at a back panel of the latch housing. The back panel has an exterior side and an interior side and has an opening therethrough A recess is defined in the latch housing by the top wall, bottom wall, first side wall, second side wall and the back panel. A paddle is associated with the latch housing within the recess and is flush with the front panel. The paddle has a top edge, a bottom edge, a first side edge, and a second side edge that define the perimeter thereof, a rear surface and a cam on the rear surface. The rear surface is next to the back panel. The cam has a cam face that preferably is highly pitched and helical. The paddle is pivotally secured to the first and second side walls at the first and second side edges, respectively, adjacent to the top wall and the top edge of the paddle. The bottom wall and the bottom edge form an opening therebetween capable of receiving an operator's fingers. A cam follower has a stud and a cam follower edge. The cam follower is placed on the exterior back panel side with the stud extending through the back panel opening. The cam follower edge is operably associated with the cam face so that moving the paddle away from the back panel rotates the cam follower and the stud. A pivot plate has an opening therethrough that is aligned with the back panel opening and has an arm. The pivot plate is positioned on the interior back panel side. The stud extends through the openings in the back panel and pivot plate to secure the pivot plate, back panel and cam follower together. The pivot plate is operably associated with the stud so that rotation of the stud causes the pivot plate to pivot. A plunger bolt is operably associated with the pivot plate arm in a recess in the plunger bolt that receives the arm. The plunger bolt extends beyond the housing in a direction so that as the paddle is pivoted in a direction, the plunger bolt moves in that direction. The arm helps maintain the plunger bolt in position. It is the cooperation of the cam, cam follower and pivot plate that results in the plunger bolt traveling in the same direction as the paddle during retraction of the plunger bolt by the paddle.

The cam face engages the cam follower edge as the paddle is moved to cause rotation of the cam follower. The cam face causes the transfer of the substantially rotational motion of the paddle to the rotational motion of the cam follower with the rotational motions of the paddle and cam follower being in planes that are perpendicular to each other. When the cam face is a helical cam face that has a screw-like surface, the shape of the helical cam face helps maintain contact between the helical cam face and cam follower edge. The rotational motion of the cam follower, and hence of the pivot plate, is transferred to the linear motion of the plunger bolt by the arm.

The stud can substantially fill the opening in the back panel with the remainder of the cam follower covering the opening. This minimizes, or preferably eliminates, the transport of moisture through the opening. Thus, the cam follower can function as a moisture barrier and thereby protect the elements of the latch on the side of the back panel opposed to the side having the cam follower thereon.

The stud can have a snap fastener tip having two cantilevers with sloped flanges. As the tip is inserted through the opening in the pivot plate, the cantilevers are forced towards each other. After the sloped flanges of the cantilevers extend beyond the pivot plate opening, the cantilevers snap back into position to secure the pivot plate, back panel and cam follower together as by using the sloped flanges. The pivot plate, back panel and cam follower can be put together quickly and easily without the need for riveting or other like fastening device that are time consuming to install. Also, the snap fastener tip permits the pivot plate, back panel and cam follower to be readily separated if desired.

The pivot plate can have at least one finger extending therefrom that is operably associated with a rod. This rod is retracted and extended substantially simultaneously with the plunger bolt. The rod can be utilized to provide a closure point in addition to that provided by the plunger bolt. That is, the rod can operate a remotely located plunger bolt. Alternatively, the rod can be utilized to perform work such as activating or deactivating a switch that indicates the door is closed or open.

Alternatively, the pivot plate can have two fingers each of which is operably associated with a rod that operates a remotely located plunger bolt and these are the only plunger bolts that secure the door shut.

The latch housing can also have a plunger bolt support in which the plunger bolt is at least partially supported and which can guide the movement of the plunger bolt. The plunger bolt support protects the plunger bolt from tampering and can have a spring contained therein to urge the plunger bolt into the extended position when the paddle is released.

Optionally, the latch can include a lock mechanism to prohibit rotation of the paddle and thereby lock the door shut.

The flush door lock assembly is typically utilized in a door that opens upwardly. Thus, the plunger bolt is directed downwardly and the paddle is lifted up to retract the plunger bolt. Because the paddle is lifted up, as opposed to being pulled down, as in many conventional latch assemblies, the paddle hangs downward and there is less likelihood that the paddle will hang away from the door. The likelihood of the door accidentally opening due to something hooking on the paddle is thereby greatly reduced because the paddle travels upward to retract the plunger bolt.

The exterior corners of the front face can be curved and the edges along the perimeter of the latch housing can be radius or curved in the same plane as the front face to provide an aesthetically pleasing appearance. Also, the front panel and paddle can be slightly curved or crowned to improve the appearance of the latch assembly.

The front panel can be textured to improve the aesthetics of the flush door latch assembly.

Numerous other advantages and features of the present invention will become readily apparent from the following detailed description of the invention, the figures and the appended claims.

DETAILED DESCRIPTION OF THE PREFERRED EMBODIMENTS

Although this invention is susceptible to embodiment in many different forms, preferred embodiments of the invention are shown. It should be understood, however, that the present disclosure is to be considered as an exemplification of the principles of this invention and is not intended to limit the invention to the embodiments illustrated.

Figure 1:
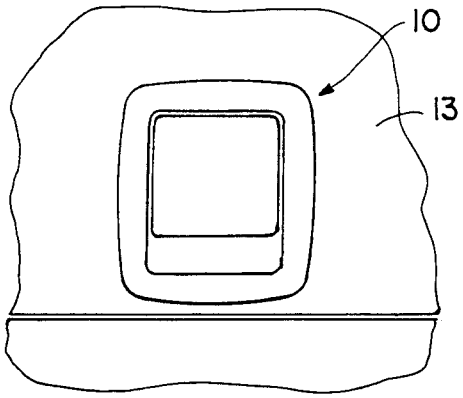
FIG. 1 is a schematic representation of the flush door latch assembly in a door.

A flush door latch assembly 10 is illustrated in FIG. 1 installed in a door 13 that opens upward.

Figure 2:
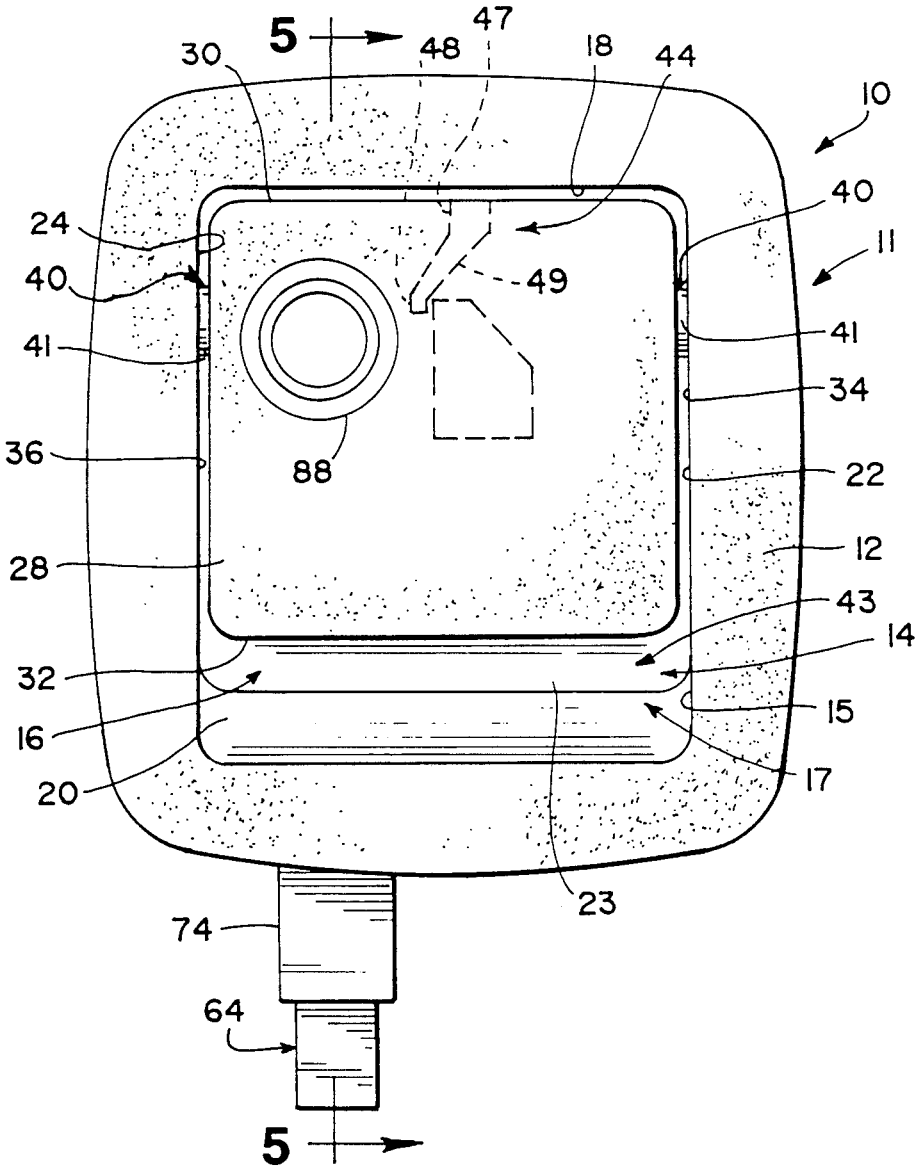
FIG. 2 is a front perspective view of the flush door latch assembly.
Figure 3:
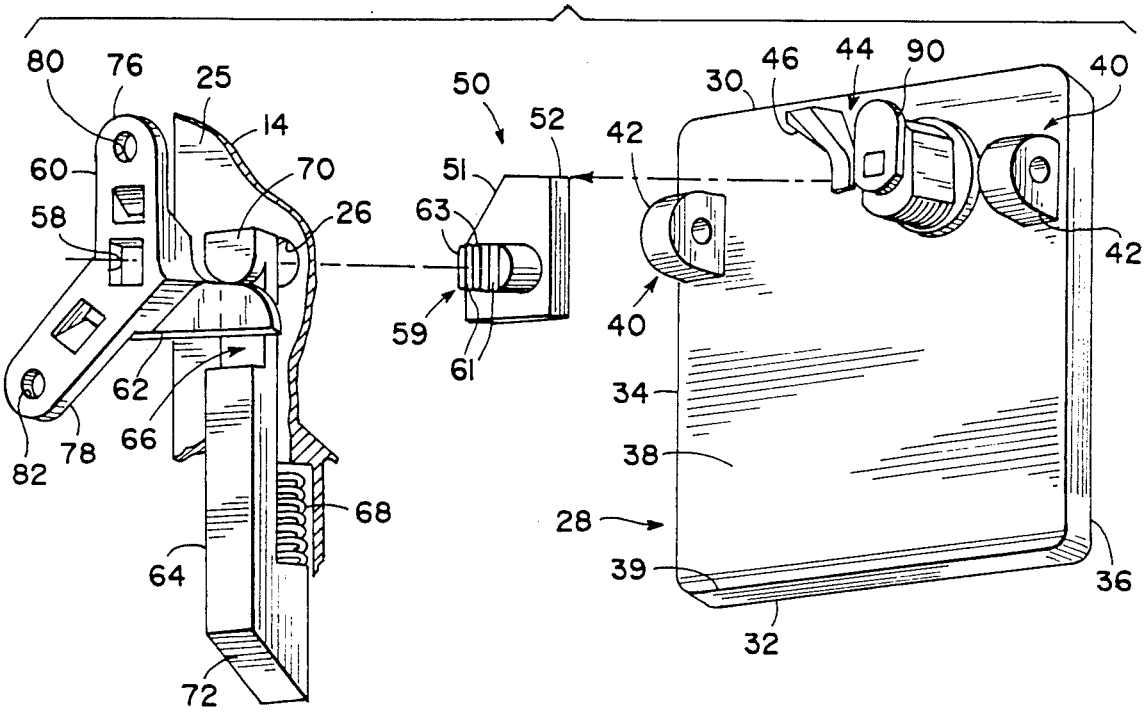
FIG. 3 is an exploded view of a paddle, cam follower, section of the back panel, pivot arm and plunger bolt of the flush door latch assembly.
Figure 4:
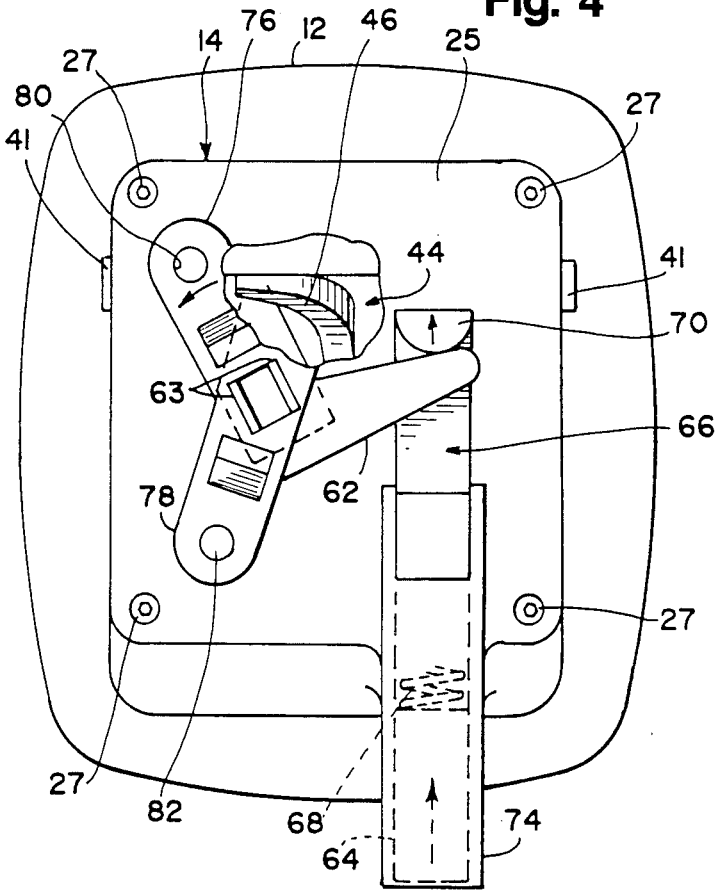
FIG. 4 is a back, partially broken away, perspective view of the flush door latch assembly.

The flush door latch assembly 10 is illustrated in FIGS. 2, 3 and 4. A latch housing 11 of the latch assembly 10 has a generally rectangular front panel 12 terminating at an inner rectangular edge 15 that forms a perimeter of a centrally located opening 17. A connected top wall 18, bottom wall 20, first side wall 22 and second side wall 24 of the latch housing 11 extend inwardly from the edge 15 and terminate at an exterior side 23 of a back panel 14 to define a recess 16. The latch housing 11 is advantageously of integral construction. The back panel 14 also has an opening 26 therethrough and an interior side 25 and can have pilot holes 27 on the interior side 25 for self-tapping installation screws.

A paddle 28 is positioned within the recess 16 flush with the front panel 12. The paddle 28 can be a rectangular plate and has a top edge 30, a bottom edge 32, a first side edge 34, and a second side edge 36 that define the perimeter of the paddle 28. The paddle 28 has a rear surface 38.

Hinge assemblies 40 secure the paddle 28 to the housing 11 and permit pivoting of the paddle 28 about the hinge assemblies 40. The hinge assemblies 40 secures the paddle 28 at the first side edge 34 to the first side wall 22 and at the second side edge 36 to the second side wall 24. The hinge assemblies 40 are positioned near the top edge 30 and the top wall 18. The hinge assemblies 40 can include bushings 41 and brackets 42 having holes therethrough that receive pins (not shown) extending from the first and second walls 22 and 24. The bushings 41 prevent lateral movement of the paddle 28 within the recess 16.

The bottom wall 20 of the latch housing 11 and the bottom edge 32 form an opening 43 therebetween. The opening 43 permits fingers of an operator (not shown) to be inserted therein and underneath the paddle 28 for operation of the latch assembly 10. A ridge 39 can extend from the rear surface 38 in close proximity to the bottom edge 32 to facilitate gripping of the paddle 28. The bottom wall 20 can be sloped to facilitate insertion of the fingers.

The rear surface 38 of the paddle 28 has an elongated cam 44 extending therefrom in proximity to the top edge 30. The cam 44 has a helical cam face 46 and two spaced short sections 47 and 48 that are parallel to the first side edge 34 and connected by an elongated section 51 that extends diagonally between the two short sections 47 and 48.

A cam follower 50 is a generally rectangular plate with a corner that is a cam follower edge 52 and an opposed truncated corner 51 that helps identify the cam follower edge 52.

A stud 56 extends from a surface 57 of the cam follower 50 at the end opposed from the cam follower edge 52. The stud 56 extends through the opening 26 in the back panel 14. Preferably, the opening 26 and the stud 56 are sized to minimize or eliminate moisture transport through the back panel 14. The helical cam face 46 maintains contact with the cam follower edge 52 even as the paddle 28 is being pulled outward and upward towards one of the sides of the latch assembly 10. Thus, even though the rear surface 38 is moving away from the cam follower 50 the helical cam face 46 and the cam follower edge 52 remain in contact.

An opening 58 that extends through a pivot plate 60 receives a snap fastener tip 59 of the stud 56. The pivot plate 60 is on the interior side 25 of the back panel 14. The snap fastener tip 59 can have two cantilevers 61 each having a sloped flange 63 so that the snap fastener tip 59 is deflected as it travels through the opening 58 and snaps open upon exiting the opening 58. The flanges 63 maintain the stud 56 within the opening 58. The sloped flanges 63 give the snap fastener tip 59 an arrow head-like shape. The stud 56 maintains the cam follower 50, the back panel 14 and the pivot plate 60 in the desired operational relationship by a section 57 that is received within the like-shaped opening 58. Preferably, the section 57 and the opening 58 are rectangular. The snap fastener tip 59 can urge the cam follower 50, the back panel 14 and the pivot plate 60 together.

The pivot plate 60 has an arm 62 extending therefrom. A plunger bolt 64 has a recess 66, that receives the arm 62 and has a tab 70. In operation, as discussed below, the arm 62 acts upon the tab 70. A compression spring 68 cooperates with the back panel 14 to urge the plunger bolt 64 into its extended position. The plunger bolt 64 can have a sloped face 72 that cooperates with a plunger bolt mating element (not shown) of a door frame (not shown) to facilitate closure of the door when the plunger bolt 64 is not retracted by the paddle 28 during closure of the door. To this end, the recess 66 can be longer than the arm 62 is wide to permit the plunger bolt 64 to be forced into its retracted position by a force applied to the sloped face 72 without acting upon the arm 62. The plunger bolt 64 can be encased within a plunger bolt support 74 for a portion of its length to support and guide the plunger bolt 64 and to protect the plunger bolt 64 from tampering.

Figure 5:
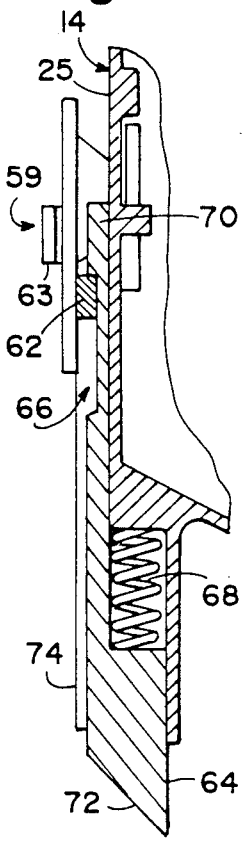
FIG 5 is a side sectional view of the flush door latch assembly taken through line 4—4 of FIG. 1.

FIG. 5 shows the plunger bolt in its extended position. The plunger bolt 64 slides along the interior side 23 of the back panel 14 in response to forces exerted upon the plunger bolt 64. Such forces can be supplied by the arm 62, the spring 68 or elements acting upon the sloped face 72.

Figure 6:
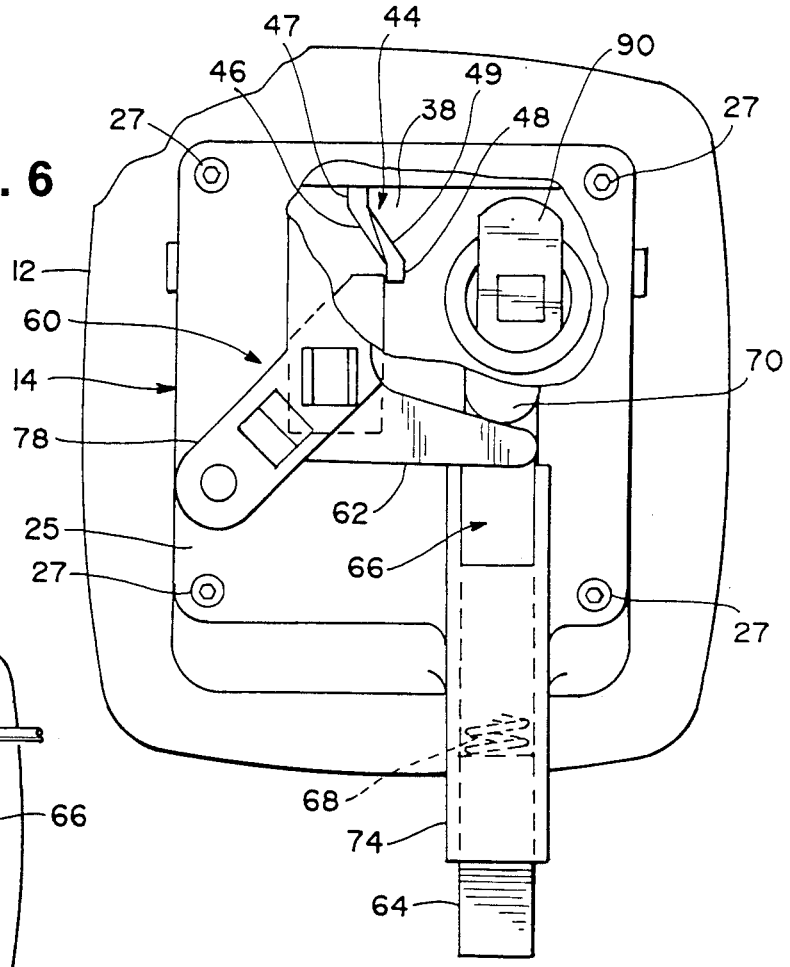
FIG 6 is a back, partially broken away perspective view of the operation of the flush door latch assembly.

As shown in FIG. 6, the substantially rotational motion of the paddle causes the rotational motion of the pivot plate 60 by the cooperation of the helical cam face 46 and the cam follower edge 52 that in turn causes rotation of the cam follower 50 and the pivot plate 60. The arm 62 cooperates with the tab 70 to transfer the rotational motion of the pivot plate 60 to a linear motion that provides the necessary force to retract the plunger bolt 64 by overcoming the force of the spring 68 and compressing the spring 68. The plunger bolt 64 can be retracted an amount effective to permit the door to be opened. This retraction can entail the plunger bolt 64 being partially or entirely retracted into the plunger bolt support 74.

Figure 7:
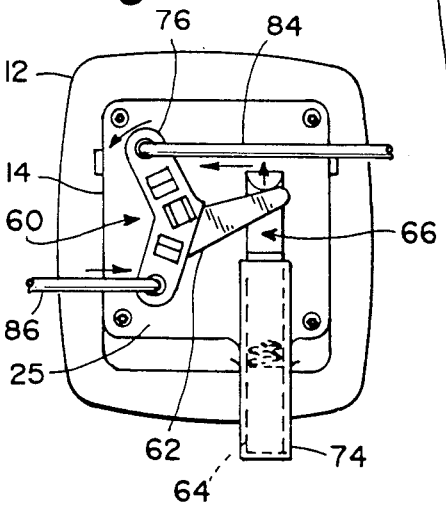
FIG. 7 is a back perspective view of an alternative embodiment of the flush door latch assembly having rods and a plunger bolt.

The pivot plate 60 can include at least one of first finger 76 or second finger 78 extending in the same plane as the plane of the pivot plate 60 with the arm 62, first finger 76 and second finger 78 being located about 120° away from each other. The fingers 76 and 78 have therethrough opening 80 and opening 82, respectively. The alternative embodiment of the flush door latch assembly 10A shown in FIG. 7 has the openings 80 and 82 utilized to receive first rod 84 and second rod 86, respectively, therein. The first rod 84 and the second rod 86 are retracted or extended when the plunger bolt 64 is retracted or extended by the pivot plate 60. The rods 84 and 86 can cooperate with the door frame to provide additional closure points such as those achieved using remote plunger assemblies (not shown). Alternatively, one or both of the rods 84 and 86 can operate other elements such as switches indicating the position of the pivot plate 60 or can be used to open the latch assembly 10 from a remote location.

An optional key plug 88 can be provided within the paddle 28. A key (not shown) rotates locking pawl 90 into a locked and unlocked condition to permit or prohibit rotation of the paddle 28 to achieve an unlocked or locked condition of the door.

Figure 8:
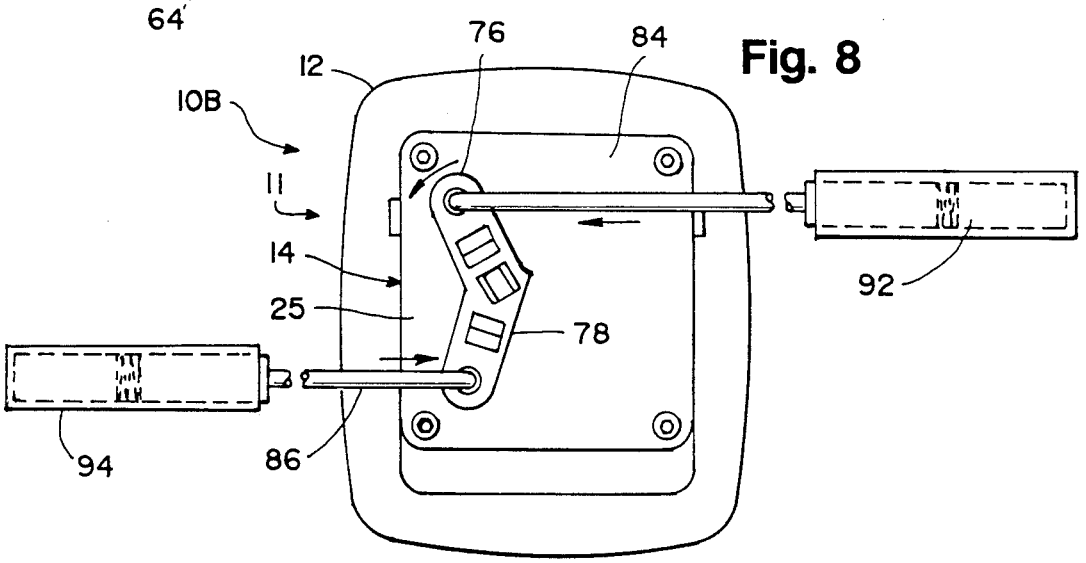
FIG. 8 is a back perspective view of an alternative embodiment of the flush door latch assembly having only rods.

FIG. 8 shows an alternative embodiment of the flush door latch assembly 10B wherein the fingers 76 and 78 are operably associated with the rods 84 and 86, respectively. The rods 84 and 86 each operate a remotely located plunger bolts 92 and 94, respectively, that maintain the door in a closed position The remotely located plunger bolts 92 and 94 can be the only plunger bolts in this flush door latch assembly 10B.

The flush door latch assembly 10 can be installed in a conventional door, hatch, lid, and the like by providing an opening therethrough having dimensions sufficient to receive the back panel, and elements thereon, and the plunger bolt. A plate (not shown) can be placed over the opening on the side of the door opposed to the side the latch assembly is inserted to cover the opening. A recess (not shown) is provided in the frame of the door to receive the plunger bolt. Screws can be inserted through the plate and into the pilot holes in the back panel.

The cam follower, pivot plate and plunger bolt can be made of materials that exhibit reduced friction to facilitate movement thereof and provide a smooth movement. Representative of these materials are teflon and nylon.

The cooperation between the cam face and the cam follower edge transfers the substantially rotational motion of the paddle as it is pulled into the rotational motion of the pivot plate. The rotational motion of the pivot plate is transferred into linear motion by the cooperation of the arm of the pivot plate and the tab of the plunger bolt to provide the force to retract the plunger bolt. When the plunger bolt faces down, the paddle is lifted up thus minimizing the possibility of the door being accidentally opened.

The present flush door latch assembly is designed to minimize, or eliminate, moisture from passing through the opening in the rear panel due to the selection of the sizes of the back panel opening and the cam follower.

The snap fastener tip of the stud permits the cam follower, back panel and pivot plate to be put together or taken apart easily without the use of fastening devices that are more difficult or time consuming to use.

This invention has been described in terms of specific embodiments set forth in detail, but it should be understood that these are by way of illustration only and that the invention is not necessarily limited thereto. Modifications and variations will be apparent from this disclosure and can be resorted to without departing from the spirit of this invention, as those skilled in the art will readily understand. Accordingly, such variations and modifications of the disclosed invention are considered to be within the purview and scope of this invention and the following claims.

What is claimed is:

1. A flush door latch assembly suitable for use in a door for maintaining the door in a closed position and permitting the door to be opened, the latch assembly comprising:

a latch housing having a front panel, an edge that forms a perimeter of a centrally located opening in the front panel, walls turned inwardly from the edge, and a back panel having an exterior side and an interior side, the walls terminating at the exterior side of the back panel, the walls and back panel defining a recess, the back panel having an opening therethrough;

a paddle associated with the housing within the recess, the paddle having a rear surface adjacent to the back panel and a cam on the rear surface, the cam having a cam face;

a cam follower having a stud extending therefrom through the back panel opening and a cam follower edge, the cam follower being on the exterior side of the back panel, the cam follower edge being operatively associated with the cam face;

a pivot plate on the interior side of the back panel, the pivot plate having an opening therethrough receiving the stud and means for securing the pivot plate, back panel and cam follower together; and a plunger bolt on the interior side, the plunger bolt having a recess therein that receives the pivot plate, wherein rotation of the paddle causes the cam face to act upon the cam follower edge to rotate the cam follower and thereby rotate the pivot plate to retract the plunger bolt.

2. The flush door latch assembly in accordance with claim 1 wherein the cam face is a helical cam face.

3. The flush door latch assembly in accordance with claim 1 wherein the cam follower provides a substantially moisture proof seal of the opening in the back panel by the stud and back panel opening being sized so the stud substantially fills the back panel opening.

4. The flush door latch assembly in accordance with claim 1 wherein the securing means is a snap fastener tip on the stud.

5. The flush door latch assembly in accordance with claim 1 wherein the cam follower and the pivot plate are made of a material exhibiting reduced friction.

6. The flush door latch assembly in accordance with claim 1 wherein the plunger bolt recess is longer than the arm is wide.

7. The flush door latch assembly in accordance with claim 1 wherein the pivot plate further comprises at least one finger extending therefrom and further comprising a rod affixed to the finger wherein the rod and plunger bolt are substantially simultaneously retracted and extended.

8. A flush door latch assembly suitable for use in a door for maintaining the door in a closed position and permitting the door to be opened, the latch assembly comprising:

a latch housing having a front panel, an edge that forms a perimeter of a centrally located opening in the front panel, walls turned inwardly from the edge, and a back panel having an exterior side and an interior side, the walls terminating at the exterior side of the back panel, the walls and back panel defining a recess, the back panel having an opening therethrough;

a paddle associated with the housing within the recess, the paddle having a rear surface adjacent to the back panel and a cam on the rear surface, the cam having a cam face;

a cam follower having a stud extending therefrom through the back panel opening and a cam follower edge, the cam follower edge being on the exterior side of the back panel, the cam follower edge being operatively associated with the cam face;

a pivot plate on the interior side of the back panel, the pivot plate having an opening therethrough receiving the stud and means for securing the pivot plate, back panel and cam follower together;

a plunger bolt on the interior side, the plunger bolt having a recess that receives therein the pivot plate arm; and a rod affixed to the finger wherein the rod and plunger bolt are substantially simultaneously retracted and extended, wherein rotation of the paddle causes the cam face to act upon the cam follower edge to rotate the cam follower and thereby rotate the pivot plate to retract the plunger bolt.

9. The flush door latch assembly in accordance with claim 8 wherein the cam face is a helical cam face.

10. The flush door latch assembly in accordance with claim 8 wherein the cam follower provides a substantially moisture proof seal of the opening in the back panel by the stud and back panel opening being sized so the stud substantially fills the back panel opening.

11. A flush door latch assembly suitable for use in a door for maintaining the door in a closed position and permitting the door to be opened, the latch assembly comprising:

a latch housing having a front panel, an edge that forms a perimeter of a centrally located opening in the front panel, walls turned inwardly from the edge, and a back panel having an exterior side and an interior side, the walls terminating at the exterior side of the back panel, the walls and back panel defining a recess, the back panel having an opening therethrough;

a paddle associated with the housing within the recess, the paddle having a rear surface adjacent to the back panel and a cam on the rear surface, the cam having a helical cam face;

a cam follower having a stud extending therefrom through the back panel opening and a cam follower edge, the cam follower being on the exterior side of the back panel, the cam follower edge being operatively associated with the cam face;

a pivot plate on the interior side of the back panel, the pivot plate having an opening therethrough receiving the stud and means for securing the pivot plate, back panel and cam follower together; and a plunger bolt on the interior side, the plunger bolt having a recess therein that receives the pivot plate, wherein rotation of the paddle causes the cam face to act upon the cam follower edge to rotate the cam follower and thereby rotate the pivot plate to retract the plunger bolt.

12. A flush door latch assembly suitable for use in a door for maintaining the door in a closed position and permitting the door to be opened and for operating a plunger bolt, the latch assembly comprising:

a latch housing having a front panel, an edge that forms a perimeter of a centrally located opening in the front panel, walls turned inwardly from the edge, and a back panel having an exterior side and an interior side, the walls terminating at the exterior side of the back panel, the walls and back panel defining a recess, the back panel having an opening therethrough;

a paddle associated with the housing within the recess, the paddle having a rear surface adjacent to the back panel and a cam on the rear surface, the cam having a cam face;

a cam follower having a stud extending therefrom through the back panel opening and a cam follower edge, the cam follower edge being on the exterior side of the back panel, the cam follower edge being operatively associated with the cam face; and a pivot plate on the interior side of the back panel, the pivot plate having an opening therethrough receiving the stud, at least one means operably associated with the pivot plate for operating the plunger bolt, and means for to securing the pivot plate, back panel and cam follower together, wherein rotation of the paddle causes the cam face to act upon the cam follower edge to rotate the cam follower and thereby rotate the pivot plate to retract the plunger bolt.

13. The flush door latch assembly in accordance with claim 12 wherein the at least one operating means is an arm.

14. The flush door latch assembly in accordance with claim 12 wherein the at least one operating means is a finger having a rod extending therefrom.

15. The flush door latch assembly in accordance with claim 12 wherein securing means is a snap fastener tip on the stud.

16. The flush door latch assembly in accordance with claim 12 wherein the cam follower and the pivot plate are made of a material exhibiting reduced friction.

* * * * *